United States Patent [19]

Heissenberger et al.

[11] 4,147,101

[45] Apr. 3, 1979

[54] PRESS FOR DEHYDRATING FIBROUS MATERIALS AND OTHER SUBSTANCES

[75] Inventors: Otto Heissenberger; Rupert Syrowatka; Ernst Tutschek, all of Graz, Austria

[73] Assignee: Maschinenfabrik Andritz Aktiengesellschaft, Austria

[21] Appl. No.: 682,677

[22] Filed: May 3, 1976

[30] Foreign Application Priority Data

May 14, 1975 [AT] Austria ..... 3694/75

[51] Int. Cl.[2] ..... B30B 9/24; B30B 5/04

[52] U.S. Cl. ..... 100/118; 100/154; 210/386; 162/360 R

[58] Field of Search ..... 100/118, 119, 120, 151, 100/152, 153, 154; 162/273, 301, 360 R; 210/386, 400, 401; 198/627, 628, 813-816; 308/22, 25; 74/242.8, 242.1 R, 242.12, 242.14 R

[56] References Cited

U.S. PATENT DOCUMENTS

| | | | |
|---|---|---|---|
| 995,283 | 6/1911 | Patton | 100/152 |
| 2,367,778 | 1/1945 | Hornbostel | 162/273 X |
| 3,446,139 | 5/1969 | Coffelt | 100/151 X |
| 3,459,122 | 8/1969 | Pastoors et al. | 100/118 |
| 3,630,158 | 12/1971 | Doornhof | 100/118 |
| 3,796,149 | 3/1974 | Heissenberger | 100/118 |
| 3,801,250 | 3/1974 | Kaiser et al. | 100/153 |
| 3,922,963 | 12/1975 | Sanderson | 100/118 |
| 3,951,809 | 4/1976 | Kollmar | 210/400 X |

*Primary Examiner*—Peter Feldman
*Attorney, Agent, or Firm*—James E. Bryan

[57] ABSTRACT

This invention relates to an improvement in a press for dehydrating material in which the material is passed between two endless sieve belts adapted to move in the same direction and to pass over and around pairs of rollers and/or offset upper and lower rollers, the rollers in various sets forming a pre-dehydration zone and a wedging or compression zone, the improvement comprising a compression zone in the form of a frame-like structure, said structure containing individual compression roller means mounted on bearing blocks of varying heights, and means for displacing and/or exchanging said bearing blocks, whereby a path for said material has an ascending slope with line compression, or is wavelike or S-shaped with surface compression.

1 Claim, 6 Drawing Figures

PRESS FOR DEHYDRATING FIBROUS MATERIALS AND OTHER SUBSTANCES

The invention relates to a press for dehydrating fibrous materials and other substances, in which the run of material to be dehydrated is made to pass between two endless sieve belts moving in the same direction and passing over and around pairs of rollers and/or offset upper and lower rollers, these rollers forming a pre-dehydration zone, and a wedging or pressing zone in different sets.

A number of dehydrating machines are known, these machines being used as so-called double-sieve presses in the field of sediment dehydration. In principle, they are provided with a wet section at the intake, which is followed by a register or pre-pressing section, the dehydrating process terminating in the main pressing section. A number of pairs of rollers press on the sieve belt and again on the run of material being created, so that the compressed water is expelled from the suspension.

Austrian Pat. No. 313,044, is an example of such a dehydrating machine; it pictorially describes these constructional sections. It was found that such machinery has the especial advantage of the pre-pressing section being inclined upwardly, the compressing rollers furthermore being provided with a certain pre-offset.

Austrain Pat. No. 314,345, describes a further system in which the wedging zone is followed by a series of compressing rollers so arranged that an upper roller is located in the roller gap of the lower rollers instead of pairs of rollers being superposed. The axial distances between the upper and lower rollers gradually decrease in the direction of sieve movement, so that an evermore pronounced and wavelike routing is imparted to the two sieve belts with the material run to be dehydrated. A further variation includes—as regards the compressing rollers—only one pair, instead of the large number of pairs, which pair is not mounted in a horizontal plane, rather, one compressing roller is followed by another, smaller roller, so that the sieve path now is subjected to an S-shaped routing. These measures ensure that the compression is increased to correspond to the progressive degree of dehydration, as explained above. In the last embodiment, the looping angle initially is increased until surface pressure can be applied in lieu of line compression.

Such dehydrating machinery is used for various kinds of muds or sediments or for dehydrating the clearing muds from paper mills. However, a given dehydration may be carried out only for a particular suspension or for similar kinds of suspensions. The drawback therefore is that the particular equipment is unsuited for other kinds of muds or sediments. Because movable dehydrating machines would be applicable only to a specific field of application, their construction is superfluous.

The invention addresses the task of creating a press comprising several variations in the design of the compression zone together with varying possibilities in depositing the materials to be dehydrated, whatever their intake consistencies. This problem is solved by the invention by a frame-like design of the machine supports in the compressing zone, single compressing rollers therein resting on bearing blocks of different heights which may be so shifted and/or exchanged that the run of material may be set to move subject to line pressure on a straight ascending path in known manner or may experience surface compression together with an S-shaped routing.

This design of the press allows advantageous dehydration of clearing muds from industrial or community filtering or sewage plants and to such an extent that generally transportation and deposit may be carried out without difficulties and without affecting the environment. Furthermore, regarding the construction of chemical facilities, for which drainage problems often are multifold, simple solutions are available. This press on one hand meets the requirement of compactness of an industrial dehydrating machine, and on the other hand it practically leaves open access to all possible modifications of applied dehydration technology.

The invention will be further described by reference to the accompanying drawings in which.

Figure 1:
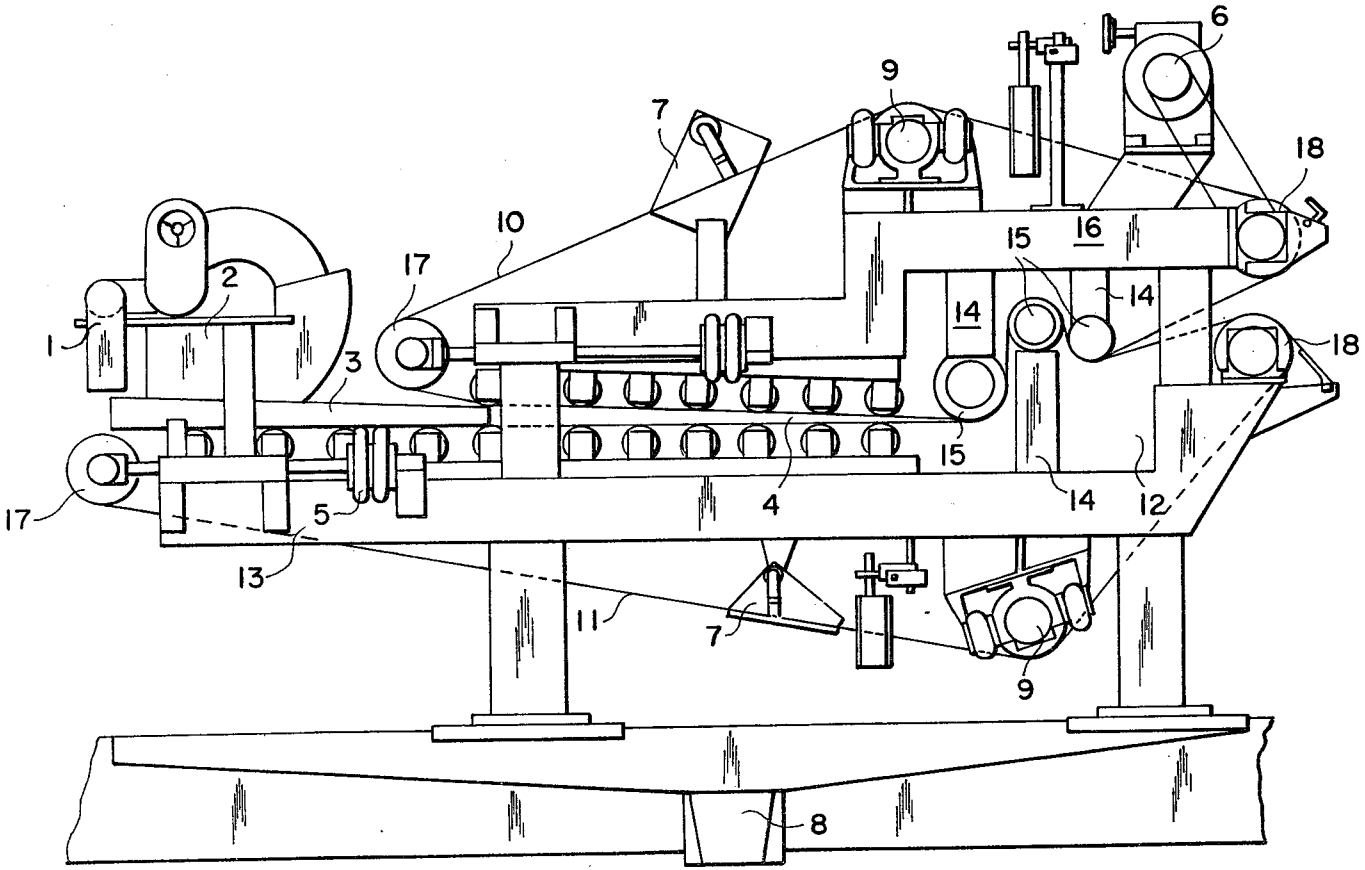
FIG. 1 is a side view of the double sieve dehydrating machine.

FIG. 1 shows a mud dehydration machine in side view; the mud or sediment supply 1 is located at the left and is connected to a mud duct with a mixing drum and drive 2. The straining zone 3 immediately follows, which zone receives the suspension in its original form. This is the position of the first dehydration phase, with gravity removing that water which is self-draining. The straining element is the lower sieve 11. The straining zone 3 is followed by the wedging zone 4, which is composed of a number of upper and lower rollers of equal diameters with gradually decreasing axial separations, viewed in the vertical direction, so that the two sieve paths 10 and 11 form a kind of a wedge. The suspension coming from the straining zone already is compressed in this wedging zone, the compression increasing in the direction of the sieve movement from pair to pair of rollers. Correspondingly, the degree of dehydration progresses sufficiently that at the end of the wedging zone 4, a filter cake is formed.

The machine further comprises a sieve tensioning system 5, the upper sieve 10 and the lower sieve 11 being moved in the same direction by a drive 6. Sieve cleaning equipment 7 is mounted at the extremities, i.e., in the upper and lower areas of the sieves 10 and 11. A filtrate drain 8 is mounted at the underside of the dehydrating machine. The machine furthermore contains an integrated sieve regulator 9.

The compression zone 12 forms the last segment of the dehydrating machine. This zone is part of the machine support 13 and is of a frame-like design 16. It comprises an upper chord **16*a* and a lower chord 16*b* (FIG. 2), with the bearing blocks 14 being mounted to these chords. The bearing blocks 14 may be shifted, so that arbitrary sieve paths may be set. The compression rollers 15 rest in the bearing blocks 14. Lastly, the rear reversing rollers 17 and the front reversing rollers 18** are shown for the sake of completeness; they bound the sieve belts.

Figure 2:
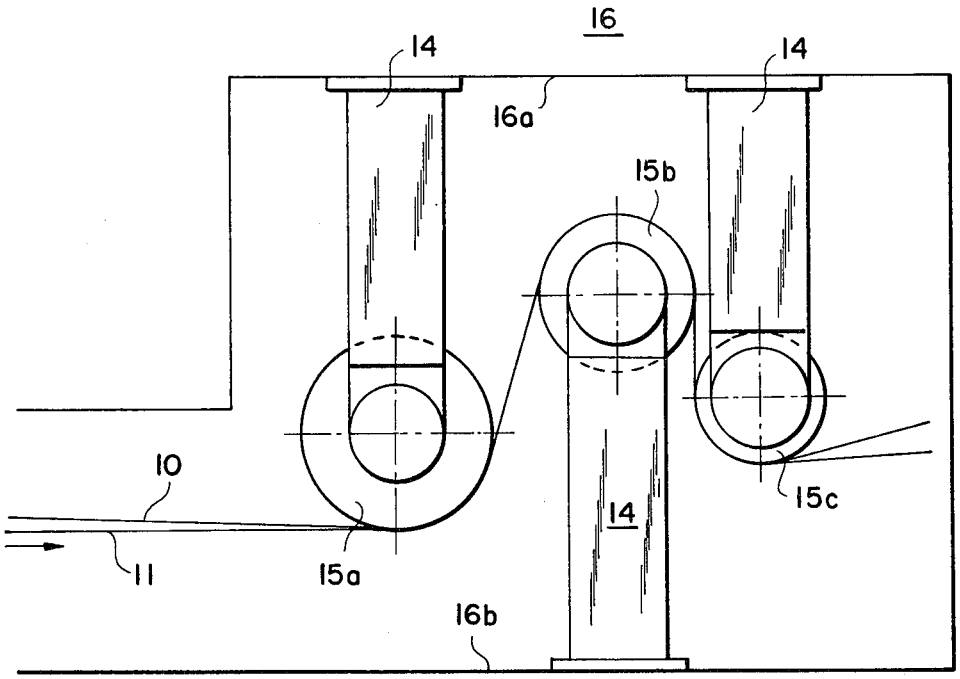
FIG. 2 is an enlarged representation of the design of the compression rollers with S-shaped routing.

FIG. 2 shows the roller arrangement in the frame-like design 16 of the dehydrating machine, already shown in FIG. 1, on a larger scale. The compression rollers 15*a*, 15*b* and 15*c* are mounted in the bearing blocks 14, which are all approximately the same size. These compression rollers are looped by the sieve belts 10 and 11 in an S-like routing. Special care is taken to make the left-hand compression roller 15*a* larger, center compression roller 15*b* relatively somewhat smaller, and last compression roller 15*c*, still smaller in diameter. The bearing blocks may be horizontally displaced, so that the looping angle about the compression rollers 15*a* through 15*c* may be arbitrarily increased or decreased.

Figure 3:
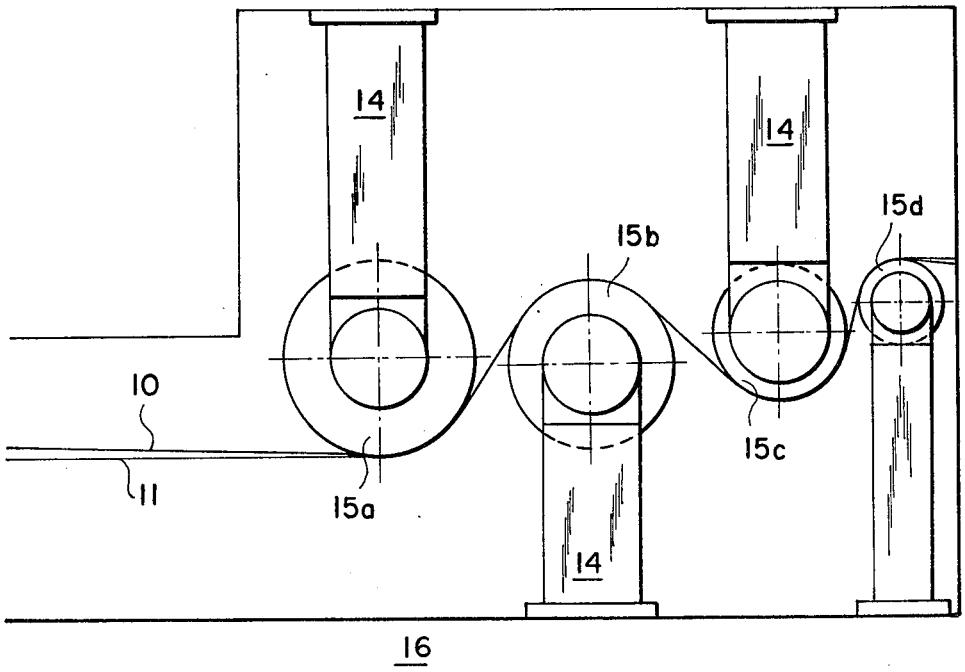
FIG. 3 shows the arrangement of compression rollers with wavelike routing.

FIG. 3 shows a number of bearing blocks 14 in the frame-like construction 16, the blocks being of such dimensions that rollers 15*a* through 15*c* will lie approximately in one plane. Therefore the sieve belts 10 and 11 are subjected to a wavelike routing, the roller diameters again gradually decreasing in the direction of movement of the sieve.

Figure 4:
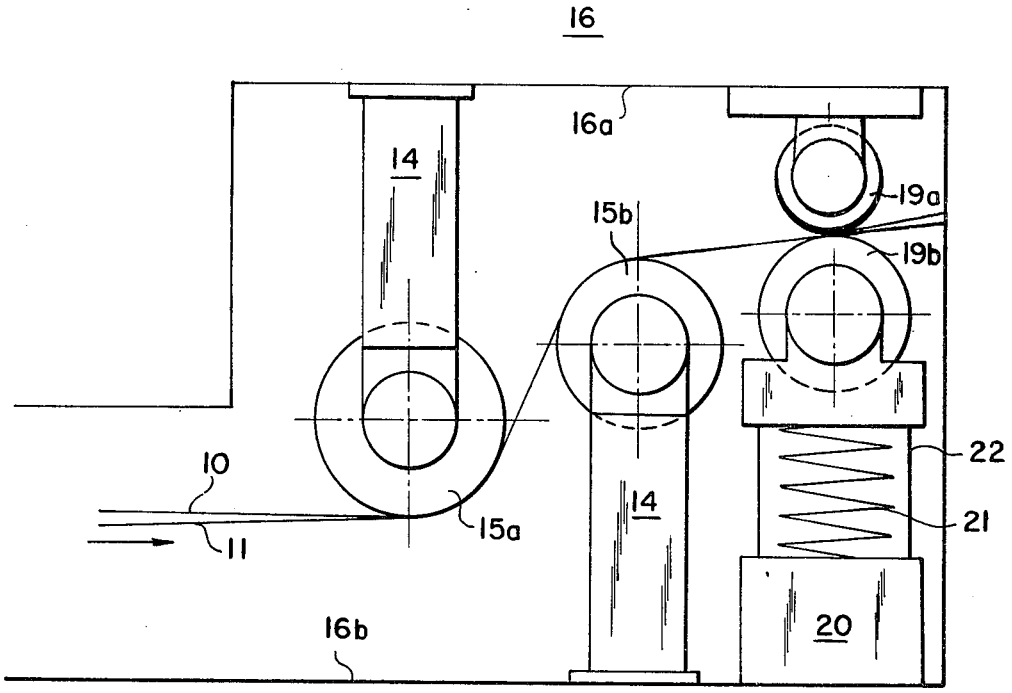
FIG. 4 shows S-like routing with a subsequent pair of rollers.

FIG. 4 shows two bearing blocks 14 in the frame-like construction 16, one being mounted to the upper chord 16*a* and the next to the lower chord 16*b*, and of such height that at first the sieve belts 10 and 11 undergo a minor, S-shaped routing. Another pair of rollers follows the rollers 15*a* and 15*b*, including the lower roller 19*b* on a smaller bearing block 20, a guide 22 being provided between the roller bearing and the bearing block 20, so that by means of the spring 21 the roller 19*b* may be elastically biased against the upper roller 19*a*. There is also the feasibility for fine adjustment of elevation by means of screw control. Known screw controls then may be incorporated in lieu of the guide 22.

Figure 5:
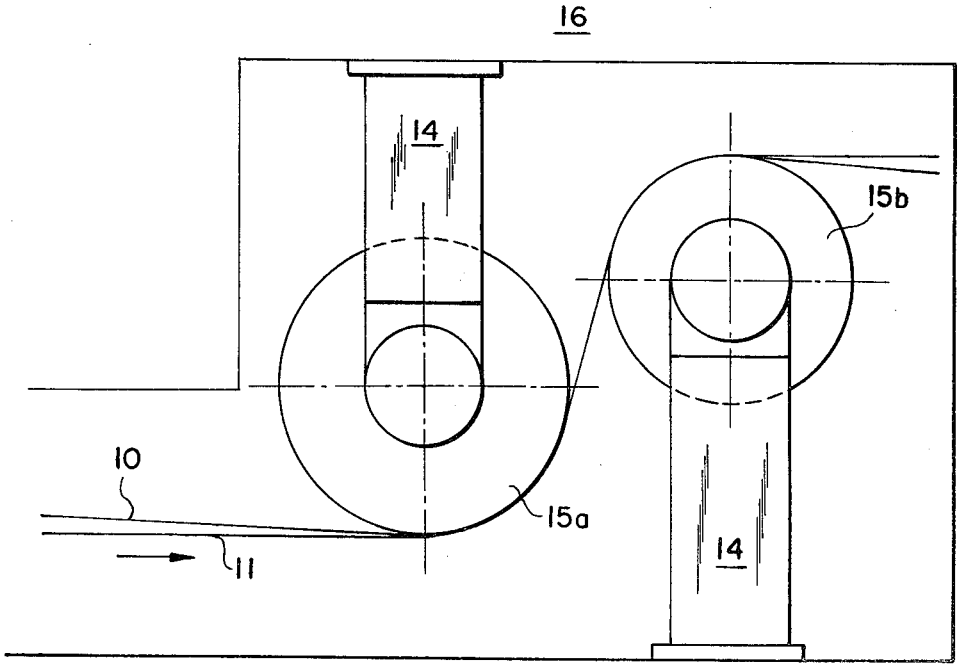
FIG. 5 shows the S-like routing with enlarged compression rollers.

The compression rollers 15*a* and 15*b* are similarly mounted in the frame-like structure 16 by means of the bearing blocks 14, as shown in FIG. 5. These two compression rollers have diameters as large as possible, for advantageous use with muds of poor mechanical stability.

The roller arrangement shown in FIGS. 2 through 5 is advantageously employed for a wavy or S-shaped routing of the sieve path with surface loading, for muds with few fibers, such as biological or secondary muds.

Figure 6:
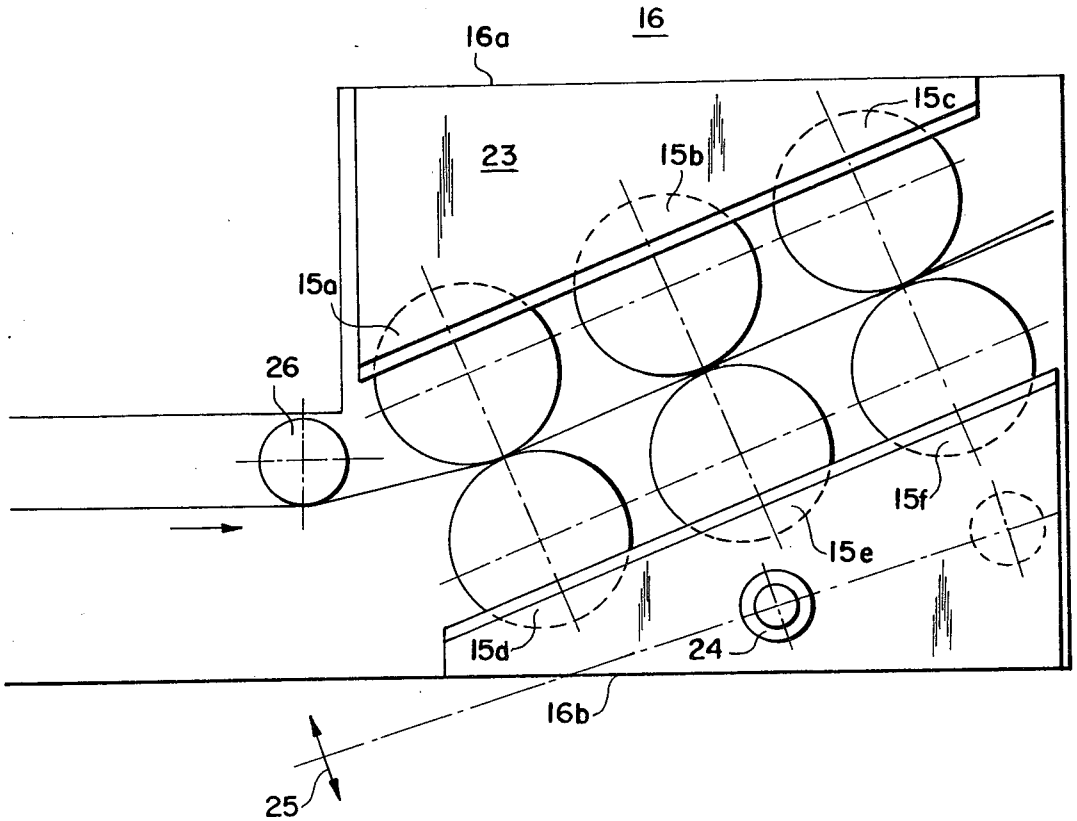
FIG. 6 shows the pairs of compression rollers with an ascending material path.

The roller arrangement shown in FIG. 6 is an example of sieve belts following a straight path, a line compression being exerted on the filter cake. A wedge-shaped construction unit 23 is so used as a roller support in the frame-like structure 16 both at the upper chord 16*a* and at the lower chord 16*b* that the material path will ascend in the direction of the sieve movement. The wedge-shaped construction unit 23 is rigidly connected to the upper chord 16*a*. The unit is pivotally mounted on the bearing 24 at the lower chord 16*b*, so that lower rollers 15*d* through 15*f* exert different pressures on the upper rollers 15*a* through 15*c*. The arrow 25 shows the possible direction of adjustment for the lower constructional, wedge-shaped unit 23. a reversing roller 26 is mounted ahead of the intake to such a compression zone, for the purpose of achieving improved transition of the sieve belts 10 and 11.

Virtually all and any desirable modifications may be employed when such a dehydrating machine with a frame-like design in the compression zone, using rollers as needed, is used. Not only may the machine operate at different locations, but furthermore it may process the most diverse muds, no more being required than adjustment of the rollers in the compression zone.

The dehydration material, for instance mud to be filtered or sewage to be treated, is evenly distributed over the entire operational width in the predehydration stage, and rids itself by gravity—especially if it is previously conditioned by flocculation means—of part of its interstitial water, until it is ready for compressive dehydration in the so-called wedging zone. The upper and lower sieves move toward one another in the wedging zone, and an increasing filtration compression is exerted thereby. The geometry of the wedging zone may be adapted to the particular dehydration dynamics. Lastly, the dryness of the compressed cake in the compression zone is raised to the maximum. It also is possible not only to exchange bearing blocks of different heights, but also to select rollers of different diameters as needed.

It will be obvious to those skilled in the art that many modifications may be made within the scope of the present invention without departing from the spirit thereof, and the invention includes all such modifications.

What is claimed is:

1. In a press for dehydrating material in which the material is passed between two endless sieve belts adapted to move in the same direction and to pass over and around at least one pair of rollers, which may be offset, and including a set of rollers forming a pre-dehydration zone and a set of rollers forming a wedging zone, the improvement comprising a compression zone in the form of a frame-like structure having upper and lower frame members, said upper and lower frame members containing individual compression roller means mounted on bearing blocks of varying heights, means for horizontally displacing said bearing blocks, and means for exchanging said bearing blocks, whereby a path for said material is wavelike or S-shaped with surface compression.

* * * * *